US010985475B2

(12) United States Patent
Villard et al.

(10) Patent No.: US 10,985,475 B2
(45) **Date of Patent: *Apr. 20, 2021**

(54) ELECTRICAL CONNECTION SYSTEM WITH AN ADDITIONAL LEAF SPRING

(71) Applicant: TE Connectivity Services GmbH, Schaffhausen (CH)

(72) Inventors: Romain Villard, Tassin la Demi Lune (FR); Yannick Villardier, Mions (FR)

(73) Assignee: TE CONNECTIVITY SERVICES GMBH, Schaffhausen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/337,199

(22) PCT Filed: Sep. 29, 2016

(86) PCT No.: PCT/EP2016/073300
§ 371 (c)(1),
(2) Date: Mar. 27, 2019

(87) PCT Pub. No.: WO2018/059696
PCT Pub. Date: Apr. 5, 2018

(65) Prior Publication Data

US 2019/0229440 A1 Jul. 25, 2019

(51) Int. Cl.

| | |
|---|---|
| ***H01R 4/48*** | (2006.01) |
| ***H01R 9/26*** | (2006.01) |
| *H01R 4/64* | (2006.01) |

(52) U.S. Cl.
CPC ..... *H01R 4/4809* (2013.01); *H01R 4/4827* (2013.01); *H01R 9/2608* (2013.01); *H01R 4/64* (2013.01); *H01R 9/2691* (2013.01)

(58) Field of Classification Search
CPC ..... H01R 4/4809
See application file for complete search history.

(56) References Cited

U.S. PATENT DOCUMENTS

| | | | |
|---|---|---|---|
| 5,022,873 | A | 6/1991 | Kollmann |
| 5,890,916 | A | 4/1999 | Diekmann et al. |
| 7,686,626 | B2 | 3/2010 | Wu et al. |
| 7,922,521 | B1 | 4/2011 | Wu |

(Continued)

FOREIGN PATENT DOCUMENTS

| | | |
|---|---|---|
| CN | 102593616 A | 7/2012 |
| DE | 20120811 | 4/2003 |

(Continued)

OTHER PUBLICATIONS

English Machine Translation Abstract of CN102593616, Jul. 18, 2012.

(Continued)

*Primary Examiner* — James Harvey
(74) *Attorney, Agent, or Firm* — Cantor Colburn LLP

(57) ABSTRACT

The invention relates to an electrical connection system (7) for an electrical device, such as an electrical terminal block, said electrical connection system (7) comprising: a conductive bar (21) including an electrical contact region (45) arranged to cooperate with a conductive portion (13') of an electrical conductor (13) in a connected position, and an engagement zone (35) arranged to engage with a portion (15') of a support rail (15) in an engaged position; a leaf spring (23); and a retaining device (49) arranged to maintain the engaged position with the portion (15') of the support rail (15), said retaining device (49) comprising an additional leaf spring (57) equipped with an additional clamping member (57") arranged to engage with the portion (15') of the support rail (15) in the engaged position.

15 Claims, 4 Drawing Sheets

(56) References Cited

U.S. PATENT DOCUMENTS

| | | | | |
|---|---|---|---|---|
| 7,927,132 | B1 * | 4/2011 | Lin | H01R 4/4809 439/527 |
| 2001/0051466 | A1 | 12/2001 | Bechaz et al. | |
| 2005/0079773 | A1 * | 4/2005 | Prokup | H01R 4/4809 439/709 |
| 2005/0085107 | A1 * | 4/2005 | Hackemack | H01R 4/16 439/76.2 |
| 2006/0063419 | A1 | 3/2006 | Steinkemper et al. | |
| 2008/0102715 | A1 | 5/2008 | Coffy | |
| 2008/0233782 | A1 | 9/2008 | Hoppmann | |
| 2009/0035998 | A1 | 2/2009 | Schrader | |
| 2010/0173531 | A1 | 7/2010 | Holste | |
| 2013/0133716 | A1 | 5/2013 | Buettner | |
| 2016/0248174 | A1 | 8/2016 | Ludewig et al. | |
| 2016/0314911 | A1 | 10/2016 | Knoerrchen et al. | |
| 2017/0025805 | A1 | 1/2017 | Pizzi | |
| 2019/0296460 | A1 | 9/2019 | Villard et al. | |
| 2019/0305448 | A1 | 10/2019 | Villard et al. | |

FOREIGN PATENT DOCUMENTS

| | | | |
|---|---|---|---|
| DE | 20305313 | U1 | 8/2004 |
| DE | 102004045026 | B3 | 2/2006 |
| FR | 2844105 | | 3/2004 |
| WO | 2004021521 | | 3/2004 |

OTHER PUBLICATIONS

International Search Report for Application No. PCT/EP2016/073300, dated May 12, 2017.

English Machine Translatiopn of Abstract DE102004045026.

English Machine Translatiopn of Abstract DE20305313.

International Search Report for Application No. PCT/EP2016/073297.

Written Opinion for Application No. PCT/EP2016/073297.

Written Opinion for Application No. PCT/EP2016/073298.

International Search Report for Application No. PCT/EP2016/073298.

U.S. Office Action for U.S. Appl. No. 16/337,237; dated Jun. 23, 2020.

U.S. Office Action for U.S. Appl. No. 16/337,212; dated Jan. 22, 2020.

U.S. Notice of Allowance for U.S. Appl. No. 16/337,212; dated Jun. 4, 2020.

* cited by examiner

ELECTRICAL CONNECTION SYSTEM WITH AN ADDITIONAL LEAF SPRING

CROSS REFERENCE TO RELATED APPLICATIONS

This application is a National Stage of PCT Application No. PCT/EP2016/073300 filed on Sep. 29, 2016, the contents of which are incorporated herein by reference thereto.

TECHNICAL FIELD

The present invention concerns an electrical connection system for an electrical apparatus such as a junction block, the system comprising an additional leaf spring.

BACKGROUND

It is known to use a junction block comprising an electrical connection system allowing to electrically connect an electrical conductor and a support rail.

This type of junction block also includes other sockets for connecting electrical conductors with conductive strips comprised in the body of the block.

The number of sockets implies a particular geometry of the junction block so as not to exceed the required jig in an electrical box. In particular the dimensioning of the electrical connection system may prove to be delicate.

Indeed, the system must comprise a certain number of parts to ensure good electrical contact between the electrical conductor and the support rail.

BRIEF SUMMARY

The present invention aims at overcoming all or part of the above-mentioned drawbacks.

To this end, the present invention concerns an electrical connection system for an electrical apparatus such as a junction block, the electrical connection system comprising:

- a conductive strip having an electrical contact location arranged to cooperate with a conductive segment of an electrical conductor in a connection position and a cooperation area arranged to cooperate with a segment of a support rail in a cooperation position,
- a clamping device arranged to hold the conductive segment in the connection position, such as a leaf spring comprising a bearing branch arranged to be mounted to the conductive strip and a clamping branch arranged to hold the conductive segment in the connection position,
- a holding device arranged to hold the cooperation position with the segment of the support rail, the holding device comprising an additional leaf spring provided with an additional bearing branch arranged to be mounted to the conductive strip and an additional clamping branch arranged to cooperate with the segment of the support rail in the cooperation position.

This arrangement allows designing a simple and reliable electrical connection system. Indeed, the fact of having a single conductive strip electrically connecting the support rail and the electrical conductor allows a good electrical connection while reducing the number of parts of the system to a minimum.

Materials savings can be made as well as the decrease of transformations of the base materials used when manufacturing the conductive strip, the leaf spring and the additional leaf spring.

According to another aspect of the invention, the clamping device is a device equivalent to the leaf spring, this device being arranged to hold the conductive segment in the connection position with the conductive strip.

In this case, the additional leaf spring can be qualified as a leaf spring for holding the segment of the support rail. Indeed, in this case, the qualifier «additional» no longer applies to this leaf spring.

According to this other aspect of the invention, the clamping device is a screw clamping device.

According to an aspect of the invention, the leaf spring and the additional leaf spring are identical. This arrangement allows standardizing this part, which reduces the number of references and facilitates the management of parts when manufacturing the electrical connection system.

According to an aspect of the invention, the conductive strip has a longitudinal contact surface on which are formed the electrical contact location and the cooperation area.

This arrangement allows producing a conductive strip having a simple geometry, such as a folded longitudinal blade. The manufacture of the conductive strip is thus facilitated.

According to an aspect of the invention, the cooperation area at least partially extends in the same plane as the extension plane of the electrical contact location.

According to another aspect of the invention, the cooperation area at least partially extends in a plane transverse to the plane of extension of the electrical contact location.

This arrangement also allows a simple implantation of the connecting strip in the junction block and thus achieving a space saving in comparison with a strip to which are added auxiliary devices for connection with the support rail and the electrical conductor.

The segment of the support rail and the conductive segment of the electrical conductor can thus be easily disposed proximate to one another.

Preferably, the electrical contact location extends rectilinearly according to a profile generating at least one slot. This arrangement allows a better positional holding of the conductive segment.

According to an aspect of the invention, the cooperation area comprises a first portion and a second portion, the first portion being capable of cooperating with a first complementary portion of the segment of the support rail extending in a first plane and the second portion being capable of cooperating with a second complementary portion of the segment of the support rail extending in a second plane transverse to the first plane.

This cooperation in two transverse portions enables a good respective positioning of the support rail and of the electrical connection system in the cooperation position.

The risk of inadvertent movement in the cooperation position and therefore of interruption of electrical contact between the support rail and the conductive strip is thus limited.

According to an aspect of the invention, the bearing branch extends in a plane transverse to the plane of extension of the additional bearing branch.

This arrangement allows designing a junction block in which the direction of insertion of the electrical conductor can be adapted according to the geometrical constraints.

According to an aspect of the invention, the conductive strip has a passage opening for insertion of the conductive segment in the connection position.

This arrangement allows making the conductive strip in one-piece having no weakened points because the current can still be transmitted in sufficient quantities by the two lateral branches generated by the opening.

According to an aspect of the invention, the conductive strip comprises a first portion and a second portion, the first portion facing the second portion.

This arrangement allows making a compact electrical connection system. This arrangement further allows adapting the position of the leaf spring and the additional leaf spring according to the geometrical constraints due to the shape of the junction block.

According to an aspect of the invention, the conductive strip has a U-like general shape.

This arrangement allows making the conductive strip from a rectilinear blade which is then folded. This arrangement enables a saving of material because a base sheet metal cut into rectilinear blades causes little falls, that is to say little loss of material.

According to an aspect of the invention, the additional bearing branch extends in the continuation of the second portion of the conductive strip, the cooperation area being formed in the first portion of the conductive strip.

This arrangement allows making a clip for holding the segment of the support rail in position with the cooperation area and the additional clamping branch.

Thus, the segment of the support rail is efficiently held in the cooperation position.

According to an aspect of the invention, the conductive strip is constituted by a folded conductive blade.

The manufacture of the conductive strip is easy since it is made from a cut plate which is then folded to give the conductive strip its final shape.

According to an aspect of the invention, the conductive strip is constituted by a conductive blade.

This arrangement facilitates the manufacture of the conductive strip because it originates from a flat blade which is then transformed. The mass manufacture of this single conductive part therefore allows saving production time and reducing transformation costs in comparison with a system comprising several conductive parts.

Also, a saving of material is achieved because a base sheet metal can generate a large number of blades, material falls being reduced.

According to an aspect of the invention, the conductive blade is comprised within a rectangular contour.

Indeed, since the blade is a rectangle, it is easy to find an arrangement of the cutouts to be made on the base sheet metal so as to minimize falls and produce as many conductive strips as possible.

According to an aspect of the invention, the conductive strip comprises a depression adapted for the forced fitting of a fastening portion of the bearing branch and/or comprises an additional depression adapted for the forced fitting of an additional fastening portion of the additional bearing branch.

This arrangement enables a simple and reliable mounting of the leaf spring and/or the additional leaf spring on the conductive strip. The manufacture of the electrical connection system is thus simplified.

According to an aspect of the invention, the depression is achieved by cutting the conductive blade. The depression is thus achieved during the cutting of the conductive blade, which limits the manufacturing time.

Preferably, the cutout generates a through opening in the conductive strip.

The present invention also concerns a junction block comprising an insulating body in which is formed an electrical connection system as previously described.

According to an aspect of the invention, the insulating body comprises a support segment of the bearing branch and/or an additional support segment of the additional bearing branch.

This arrangement allows ensuring the blocking of the bearing branch when the clamping branch is urged and the same applies to the additional bearing branch and the additional support segment.

Anyway, the invention will be better understood from the following description made with reference to the appended schematic drawings showing, as a non-limiting example, an embodiment of this electrical connection system.

DETAILED DESCRIPTION

Figure 1:
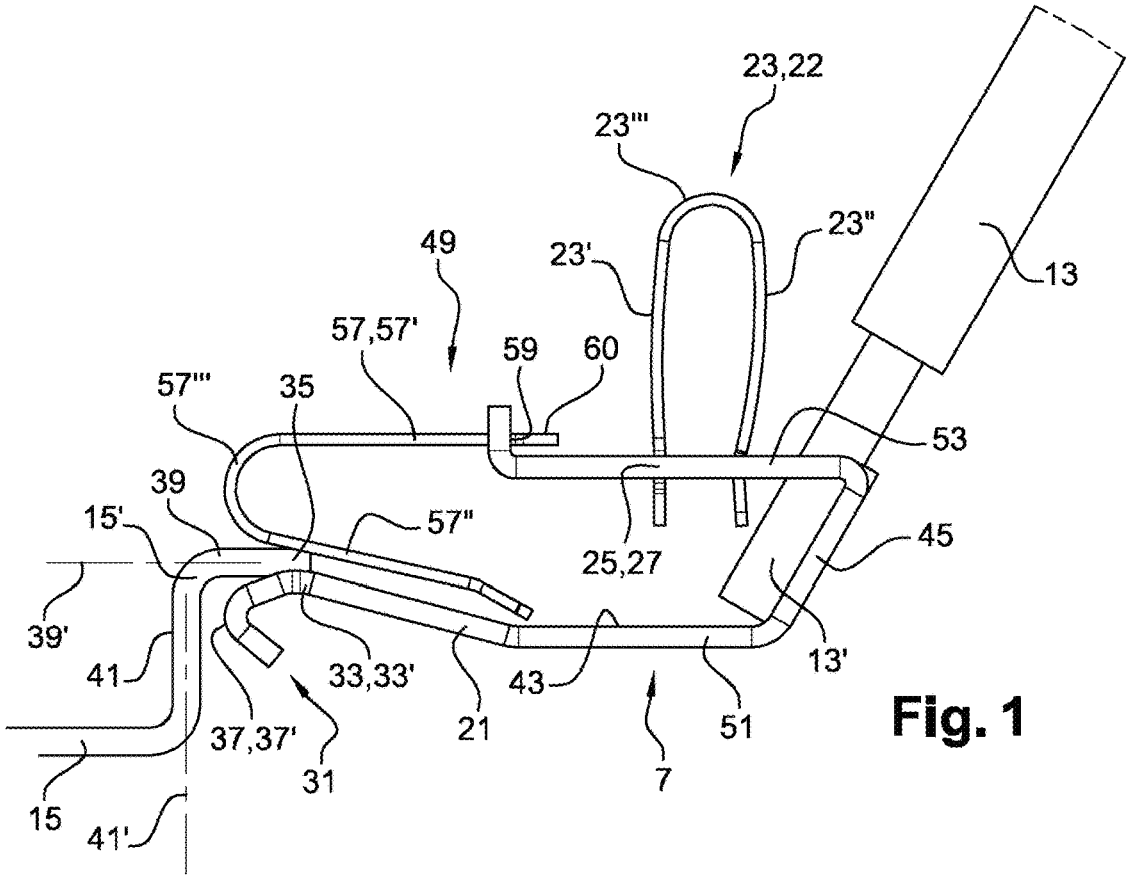
FIG. 1 is a front view of an electrical connection system, a support rail and an electrical conductor.
Figure 2:
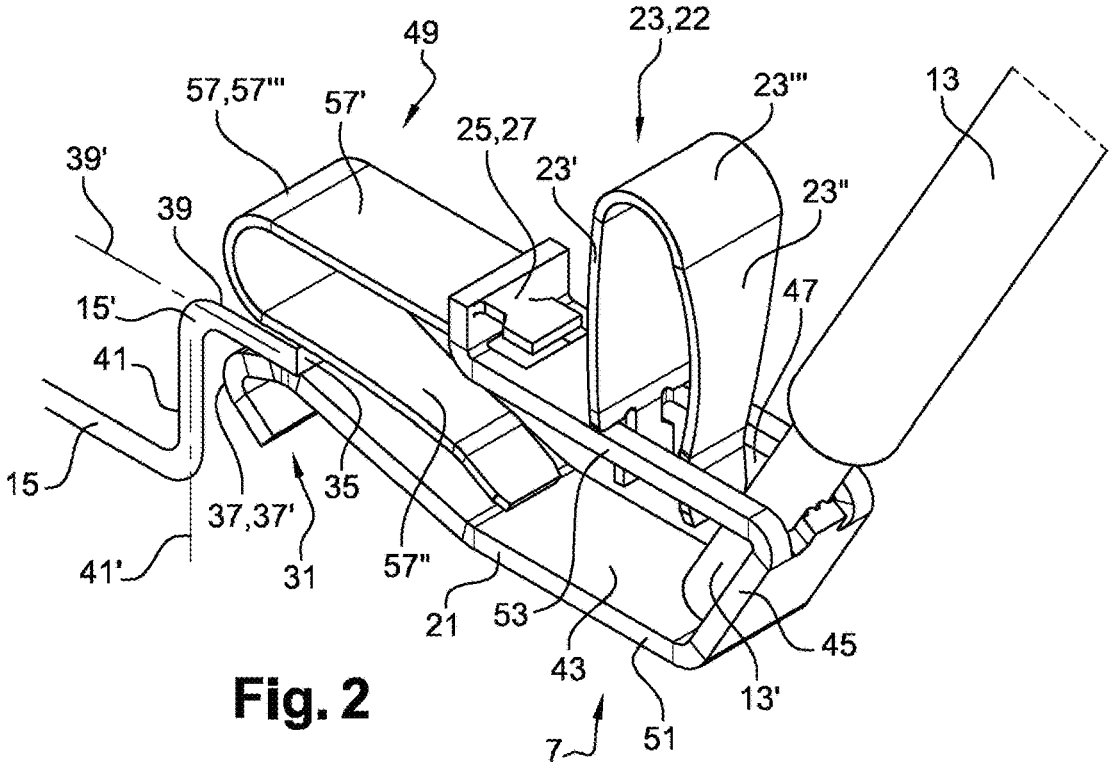
FIG. 2 is a perspective view of the electrical connection system, the support rail and the electrical conductor.
Figure 3:
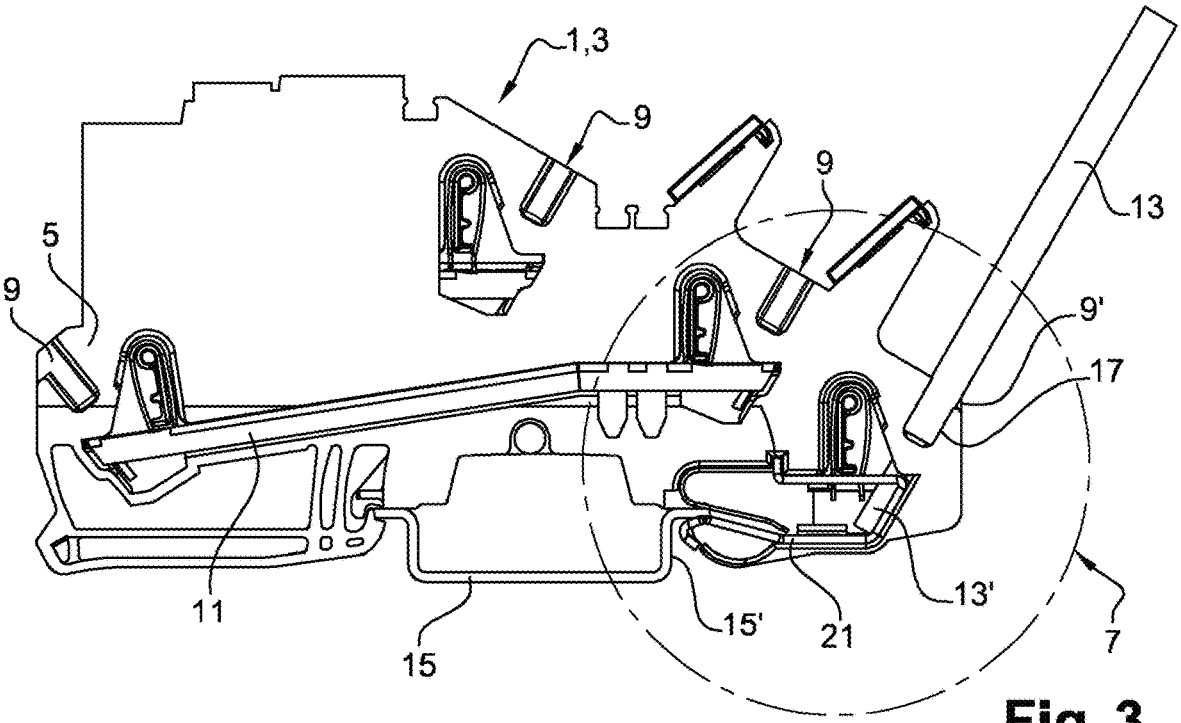
FIG. 3 is a front view of a junction block comprising the electrical connection system.
Figure 4:
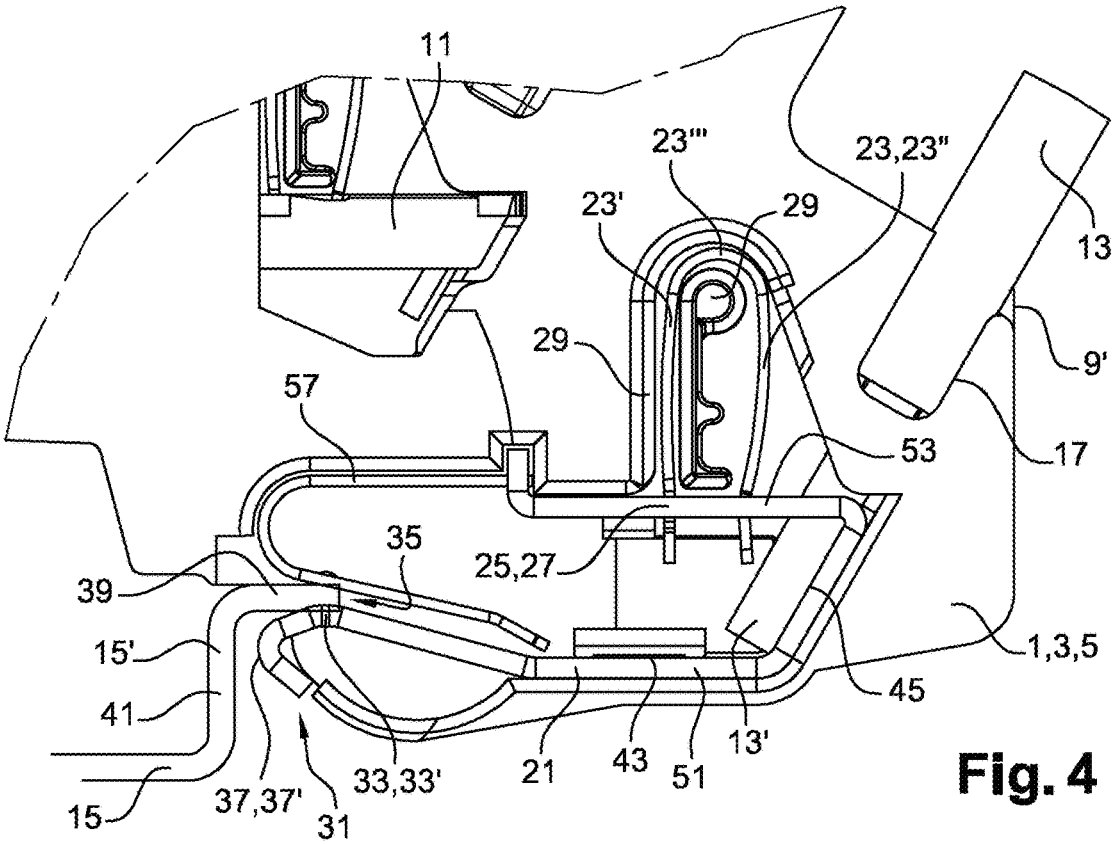
FIG. 4 is a detail view of FIG. 3 centered on the electrical connection system.
Figure 5:
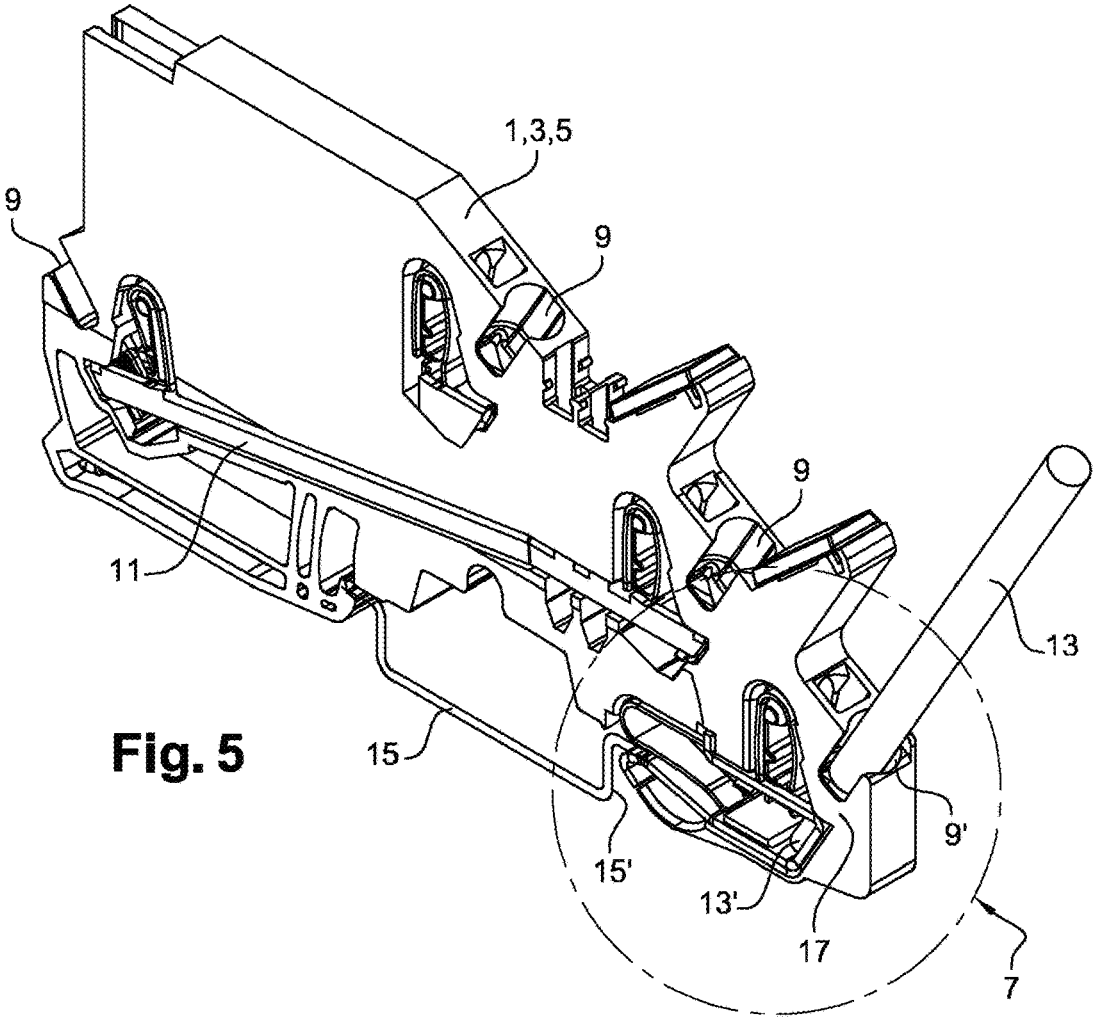
FIG. 5 is a perspective view of the junction block comprising the electrical connection system.
Figure 6:
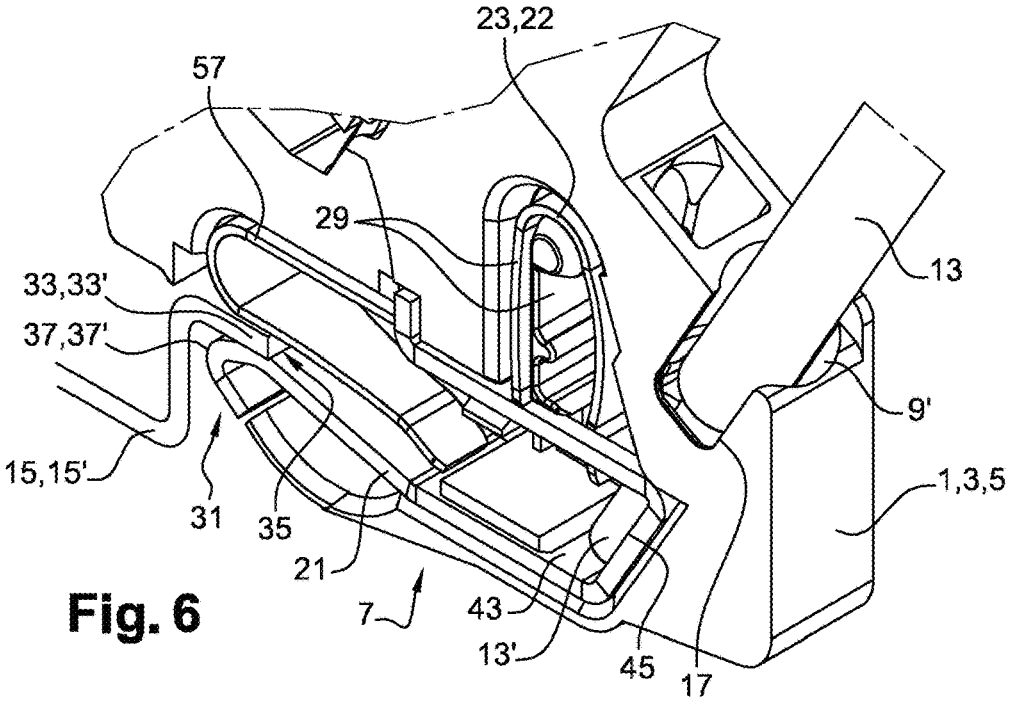
FIG. 6 is a detail view of FIG. 5 centered on the electrical connection system.

As illustrated in FIGS. 1 to 8, an electrical apparatus 1 such as a junction block 3 comprises an insulating body 5 and an electrical connection system 7, the electrical connection system 7 being formed in the insulating body 5.

The junction block 3 comprises sockets 9 for electrical conductors. Two sockets 9 are connected by a connecting bar 11 so as to establish an electrical contact between two corresponding conductors.

The junction block 3 also has a socket 9' for an electrical conductor 13 intended to be electrically connected to a support rail 15 on which the junction block 3 is removably fastened.

This electrical connection is established by the electrical connection system 9 as detailed hereinafter. The electrical conductor 13 has at one end a conductive segment 13' for example a metal tip.

The metal tip is arranged to be inserted into an insertion channel 17 of the socket 9' where it is held in position by the electrical connection system 7.

The socket 9' further comprises a maneuvering channel 19 in which a user can introduce a screwdriver-type tool for the withdrawal of the electrical conductor 13. As illustrated in FIGS. 1 to 8, the electrical connection system 7 comprises a conductive strip 21 arranged to transmit a current between the conductive segment 13' of the electrical conductor 13 and a segment 15' of the support rail 15.

The support rail 15 thus has a dual function since it enables fastening of the junction block 3 and is also used to be electrically connected to the electrical conductor 16.

The electrical connection system 7 also comprises a clamping device 22 of the leaf spring 23 type arranged to hold the conductive segment 13' in a connection position with the conductive strip 21 as illustrated in FIGS. 1, 2, 7, 8.

According to other non-detailed alternatives, any other type of clamping device 22 could be used provided that the clamping device 22 is arranged to hold the conductive segment 13' in a connection position with the conductive strip 21. A screw clamping device 22 could for example be used.

The leaf spring 23 comprises a bearing branch 23' arranged to be mounted to the conductive strip 21. For this purpose, the conductive strip 21 has a depression 25 or a through opening resulting from a cutout adapted for the forced fitting of a fastening portion 27 of the bearing branch 23'.

The leaf spring 23 also comprises a clamping branch 23" joined by a hinge 23'" to the bearing branch 23'. The clamping branch 23" is arranged to hold the conductive segment 13' in the connection position.

Indeed, the bearing branch 23' is fixed relative to the conductive strip 21 and the hinge 23'" imposes a constraint on the conductive segment 13' via the clamping branch 23".

The maneuvering channel 19 is disposed so as to enable the displacement of the clamping branch 23" for the withdrawal of the electrical conductor 13.

The insulating body 5 has a support segment 29 of the bearing branch 23' whose function is to block the bearing branch 23' during the displacement of the clamping branch 23".

The conductive strip 21 has a folded end segment 31 generating a first portion 33' of a cooperation area 35 or a cooperation extension 33 and a second portion 37' of the cooperation area 35 or cooperation stop 37.

This first portion 33' of the conductive strip 21 is arranged to cooperate with a first complementary portion 39 of the support rail 15 extending in a first plane 39'.

This second portion 37' of the conductive strip 21 is arranged to cooperate with a second complementary portion 41 of the support rail 15 extending in a second plane 41' transverse to the first plane 39'.

The conductive strip 21 also has a longitudinal contact surface 43 on which are formed an electrical contact location 45 with the conductive segment 13' in the connection position, the cooperation extension 33 and the cooperation stop 37.

The electrical contact location 45 extends rectilinearly according to a profile generating one or several slot(s) for a better holding of the conductive segment 13' in the connection position.

The conductive strip 21 further has a passage opening 47 for the insertion of the conductive segment 13' in the connection position. This passage opening 47 results for example from a cutout made before folding the conductive strip 21.

The electrical connection system 7 also comprises a holding device 49 arranged to hold the support rail 15 in a cooperation position with the conductive strip 21. The cooperation is achieved by contact, which enables a current transmission between the conductive strip 21 and the support rail 15.

The conductive strip 21 comprises a first portion 51 and a second portion 53 at least partially facing the first portion 51.

The first portion 51 comprises the longitudinal contact surface 43 and the second portion 53 cooperates with the holding device 49. Having these two portions 51, 53 allows obtaining a compact electrical connection system 7 and/or adapting to geometrical constraints imposed to the junction block 3.

The conductive strip 21 can thus be obtained by a cutout in a base sheet metal and then by folding.

As illustrated in FIGS. 1 to 6, the conductive strip may have a U-like general shape. The first portion 51 and the second portion 53 are each formed in a different U branch.

The U-like general shape of the conductive strip 21 is obtained from a conductive blade cut from a base sheet metal. The blade is comprised in a rectangular contour which allows a saving of material by limiting the falls during cutting. During cutting, the through openings are also created.

Figure 7:
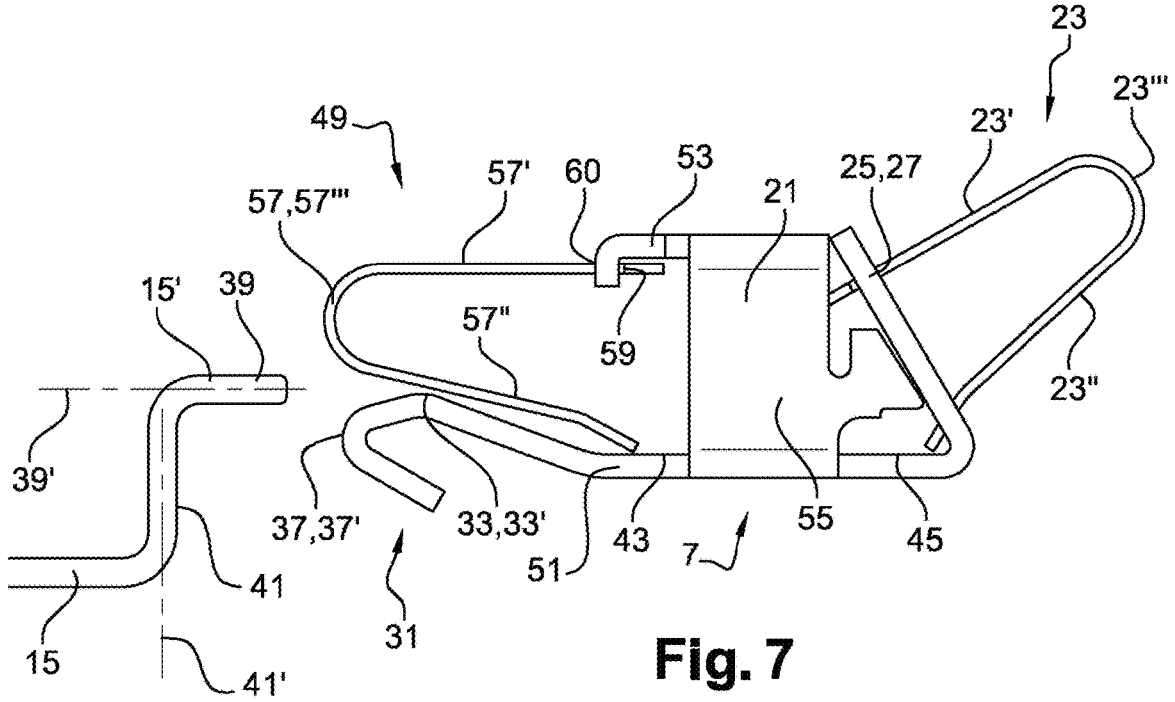
FIG. 7 is a front view of the electrical connection system and the support rail.
Figure 8:
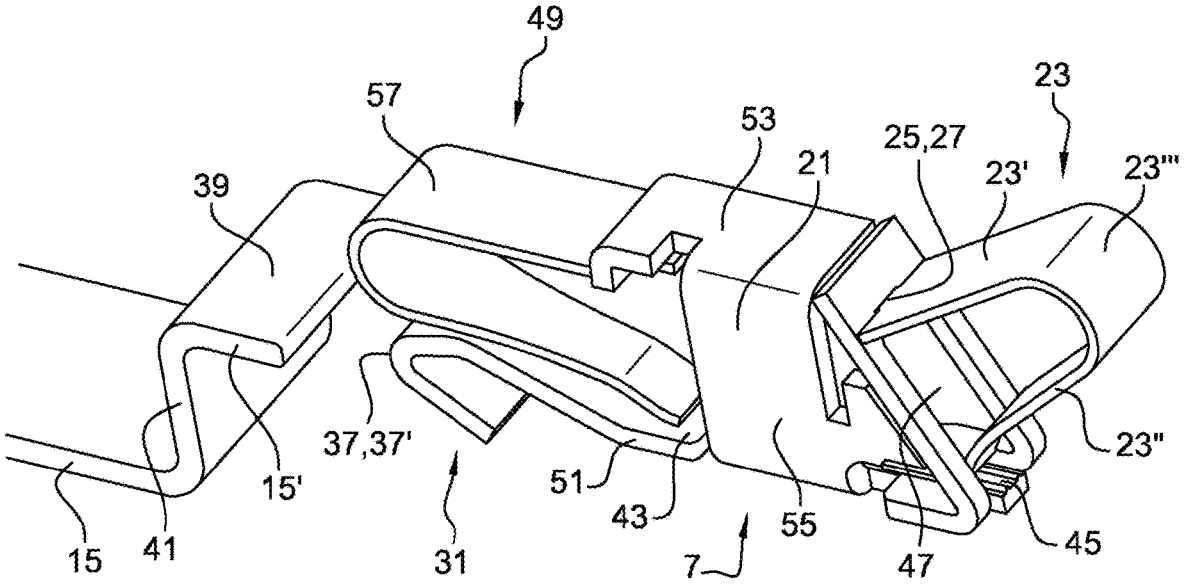
FIG. 8 is a perspective view of the electrical connection system.

Alternatively, it is possible as illustrated in FIGS. 7 and 8 to provide a conductive strip 21 before folding comprising several transverse segments connected to each other so as to generate a lateral connection 55 after folding.

This arrangement allows maintaining a large section for good current transmission once the conductive strip 21 is folded. Once folded, the conductive strip 21 also has good strength and is not likely to be deformed during mounting in the junction block 3.

The holding device comprises an additional leaf spring 57. This additional leaf spring 57 may be similar to the leaf spring holding the conductive segment 13' in the connection position.

This arrangement allows a standardization of this part and the use of one less reference for the management of parts by the manufacturer, the holding device 49 being identical to the leaf spring 23.

The additional leaf spring 57 comprises an additional bearing branch 57' provided with an additional fastening portion 60 arranged to be fastened to an additional depression 59 of the conductive strip 21 similarly to the leaf spring 23 of the conductive segment 13'.

The bearing branch 57' extends in the continuation of the second portion 53 of the conductive strip 21. This arrangement also reduces the size and therefore the material required for the manufacture of the conductive strip 21.

The additional leaf spring 57 also comprises an additional clamping branch 57" arranged to cooperate with the segment 15' of the support rail 15 in the cooperation position.

In the same manner as the leaf spring 23, the additional leaf spring 57 comprises a hinge 57. Thus, the additional clamping branch 57" holds the segment 15' of the support rail 15 in the cooperation position.

The electrical connection system 7 obtained therefore comprises few parts, is compact and is capable of meeting geometrical constraints of lack of space for its integration in the junction block.

It goes without saying that, the invention is not limited to the sole embodiment of this electrical connection system, described above as example, it encompasses on the contrary all the variants thereof.

The invention claimed is:

1. An electrical connection system for a junction block, the electrical connection system comprising:

a conductive strip having an electrical contact location arranged to cooperate with a conductive segment of an electrical conductor in a connection position and a cooperation area arranged to cooperate with a segment of a support rail in a cooperation position, wherein the conductive strip comprises a first portion and a second portion, the first portion facing the second portion so that the conductive strip has a U-like general shape;

a clamping device arranged to hold the conductive segment in the connection position, the clamping device being a leaf spring comprising a bearing branch arranged to be mounted to the conductive strip and a clamping branch arranged to hold the conductive segment in the connection position;

a holding device arranged to hold the cooperation position with the segment of the support rail;

the holding device comprising an additional leaf spring provided with an additional bearing branch arranged to be mounted to the conductive strip and an additional clamping branch arranged to cooperate with the segment of the support rail in the cooperation position, wherein the additional bearing branch extends in continuation of the second portion of the conductive strip, and wherein the cooperation area is formed in the first portion of the conductive strip.

2. The electrical connection system according to claim 1, wherein the conductive strip has a longitudinal contact surface on which are formed the electrical contact location and the cooperation area.

3. The electrical connection system according to claim 1, wherein the cooperation area comprises a first portion and a second portion, the first portion being capable of cooperating with a first complementary portion of the segment of the support rail extending in a first plane and the second portion being capable of cooperating with a second complementary portion of the segment of the support rail extending in a second plane transverse to the first plane.

4. The electrical connection system according to claim 1, wherein the bearing branch extends in a plane transverse to a plane of extension of the additional bearing branch.

5. An electrical connection system for a junction block, the electrical connection system comprising:

a conductive strip having an electrical contact location arranged to cooperate with a conductive segment of an electrical conductor in a connection posistion and a cooperation area arranged to cooperate with a segment of a support rail in a cooperation position, wherein the conductive strip has a passage opening for the insertion of the conductive segment in the connection posistion;

a clamping device arranged to hold the conductive segment in the connection position, the clamping device being a leaf spring comprising a bearing branch arranged to be mounted to the conductive strip and a clamping branch arranged to hold the conductive segment in the connection position;

a holding device arranged to hold the cooperation position with the segment of the support rail; and the holding device comprising an additional leaf spring provided with an additional bearing branch arranged to be mounted to the conductive strip and an additional clamping branch arranged to cooperate with the segment of the support rail in the cooperation position.

6. The electrical connection system according to claim 2, wherein the cooperation area comprises a first portion and a second portion, the first portion being capable of cooperating with a first complementary portion of the segment of the support rail extending in a first plane and the second portion being capable of cooperating with a second complementary portion of the segment of the support rail extending in a second plane transverse to the first plane.

7. The electrical connection system according to claim 6, wherein the bearing branch extends in a plane transverse to a plane of extension of the additional bearing branch.

8. The electrical connection system according to claim 7, wherein the conductive strip has a passage opening for the insertion of the conductive segment in the connection position.

9. The electrical connection system according to claim 1, wherein the conductive strip is constituted by a folded conductive blade.

10. The electrical connection system according to claim 1, wherein the conductive strip comprises a depression adapted for forced fitting of a fastening portion of the bearing branch and/or comprises an additional depression adapted for forced fitting of an additional fastening portion of the additional bearing branch.

11. A junction block comprising an insulating body in which is formed an electrical connection system according to claim 1.

12. The electrical connection system according to claim 8, wherein the conductive strip is constituted by a folded conductive blade.

13. The electrical connection system according to claim 12, wherein the conductive strip comprises a depression adapted for forced fitting of a fastening portion of the bearing branch and/or comprises an additional depression adapted for forced fitting of an additional fastening portion of the additional bearing branch.

14. The electrical connection system according to claim 2, wherein the bearing branch extends in a plane transverse to a plane of extension of the additional bearing branch.

15. An electrical connection system for a junction block, the electrical connection system, comprising:

a conductive strip having an electrical contact location arranged to cooperate with a conductive segment of an electrical conductor in a connection position and a cooperation area arranged to cooperate with a segment of a support rail in a cooperation position;

a clamping device arranged to hold the conductive segment in the connection position, the clamping device being a leaf spring comprising a bearing branch arranged to be mounted to the conductive strip and a clamping branch arranged to hold the conductive segment in the connection position;

a holding device arranged to hold the cooperation position with the segment of the support rail; and the holding device comprising an additional leaf spring provided with an additional bearing branch arranged to be mounted to the conductive strip and an additional clamping branch arranged to cooperate with the segment of the support rail in the cooperation position, wherein the bearing branch extends in a plane transverse to a plane of extension of the additional bearing branch.

* * * * *